US008061455B2

(12) United States Patent
Beuershausen

(10) Patent No.: US 8,061,455 B2
(45) Date of Patent: Nov. 22, 2011

(54) DRILL BIT WITH ADJUSTABLE CUTTERS

(75) Inventor: Chad J. Beuershausen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 196 days.

(21) Appl. No.: 12/393,889

(22) Filed: Feb. 26, 2009

(65) Prior Publication Data

US 2010/0212964 A1 Aug. 26, 2010

(51) Int. Cl.
*E21B 10/55* (2006.01)
*E21B 10/62* (2006.01)
*E21B 7/10* (2006.01)

(52) U.S. Cl. ..... 175/426; 175/381; 175/382

(58) Field of Classification Search ..... 175/381, 175/382, 432

See application file for complete search history.

(56) References Cited

U.S. PATENT DOCUMENTS

| | | | | | |
|---|---|---|---|---|---|
| 1,978,006 | A | * | 10/1934 | Wright | 175/379 |
| 3,548,960 | A | * | 12/1970 | Hasiba | 175/393 |
| 4,086,698 | A | | 5/1978 | Sparks | |
| 4,185,704 | A | | 1/1980 | Nixon, Jr. | |
| 4,262,758 | A | | 4/1981 | Evans | |
| 4,291,773 | A | | 9/1981 | Evans | |
| 4,416,339 | A | | 11/1983 | Baker et al. | |
| 4,638,873 | A | | 1/1987 | Welborn | |
| 4,730,681 | A | | 3/1988 | Estes | |
| 4,842,083 | A | * | 6/1989 | Raney | 175/325.4 |
| 5,158,109 | A | | 10/1992 | Hare, Sr. | |
| 5,220,963 | A | | 6/1993 | Patton | |
| 5,293,945 | A | | 3/1994 | Rosenhauch et al. | |
| 5,341,886 | A | | 8/1994 | Patton | |
| 5,361,859 | A | | 11/1994 | Tibbitts | |
| 5,419,405 | A | | 5/1995 | Patton | |
| 5,443,565 | A | | 8/1995 | Strange, Jr. | |
| 5,467,834 | A | | 11/1995 | Hughes et al. | |
| 5,553,678 | A | | 9/1996 | Barr et al. | |
| 5,671,816 | A | | 9/1997 | Tibbitts | |
| 5,678,645 | A | * | 10/1997 | Tibbitts et al. | 175/426 |
| 5,941,321 | A | | 8/1999 | Hughes | |
| 6,012,536 | A | | 1/2000 | Puttmann et al. | |
| 6,092,610 | A | | 7/2000 | Kosmala et al. | |
| 6,138,780 | A | | 10/2000 | Beuershausen | |
| 6,142,250 | A | | 11/2000 | Griffin et al. | |
| 6,173,797 | B1 | | 1/2001 | Dykstra et al. | |
| 6,209,664 | B1 | | 4/2001 | Amaudric du Chaffaut | |
| 6,253,863 | B1 | | 7/2001 | Mensa-Wilmot et al. | |
| 6,257,356 | B1 | | 7/2001 | Wassell | |
| 6,260,636 | B1 | | 7/2001 | Cooley et al. | |
| 6,290,007 | B2 | | 9/2001 | Beuershausen et al. | |
| 6,321,862 | B1 | | 11/2001 | Beuershausen et al. | |
| 6,349,780 | B1 | | 2/2002 | Beuershausen | |

(Continued)

FOREIGN PATENT DOCUMENTS

| | | |
|---|---|---|
| EP | 0874128 A2 | 10/1998 |

(Continued)

*Primary Examiner* — Kenneth L Thompson
(74) *Attorney, Agent, or Firm* — Cantor Colburn LLP

(57) ABSTRACT

A drill bit is provided that in one embodiment may include a blade profile having a cone section and one or more cutters on the cone section configured to retract from an extended position when an applied load on the drill bit reaches or exceeds a selected threshold. The drill bit is less aggressive when the cutters are in the retracted position compared to when the cutters are in the extended position.

20 Claims, 4 Drawing Sheets

U.S. PATENT DOCUMENTS

| | | | |
|---|---|---|---|
| 6,568,470 | B2 | 5/2003 | Goodson, Jr. et al. |
| 6,725,947 | B2 | 4/2004 | Palaschenko et al. |
| 6,945,338 | B1 | 9/2005 | Defourny et al. |
| 7,201,237 | B2 | 4/2007 | Raney |
| 7,287,604 | B2 | 10/2007 | Aronstam et al. |
| 7,373,995 | B2 | 5/2008 | Hughes et al. |
| 2002/0011358 | A1 | 1/2002 | Wassell |
| 2002/0088648 | A1 | 7/2002 | Krueger et al. |
| 2002/0112887 | A1 | 8/2002 | Harrison |
| 2004/0238221 | A1 | 12/2004 | Runia et al. |
| 2005/0024232 | A1 | 2/2005 | Gardner et al. |
| 2007/0192074 | A1 | 8/2007 | Chen |
| 2008/0000693 | A1 | 1/2008 | Hutton |
| 2008/0017419 | A1 * | 1/2008 | Cooley et al. ..... 175/286 |
| 2008/0127781 | A1 | 6/2008 | Ludi et al. |

FOREIGN PATENT DOCUMENTS

| | | | |
|---|---|---|---|
| EP | 1008717 | A1 | 6/2000 |
| GB | 2039567 | A | 8/1980 |
| GB | 2050466 | A | 1/1981 |
| GB | 2352464 | A1 | 1/2001 |
| WO | WO0043628 | | 7/2000 |

* cited by examiner

DRILL BIT WITH ADJUSTABLE CUTTERS

BACKGROUND INFORMATION

1. Field of the Disclosure

This disclosure relates generally to drill bits and systems for using the same for drilling wellbores.

2. Background Of The Art

Oil wells (also referred to as "wellbores" or "boreholes") are drilled with a drill string that includes a tubular member having a drilling assembly (also referred to as the "drilling assembly" or "bottomhole assembly" or "BHA") which includes a drill bit attached to the bottom end thereof. The drill bit is rotated by rotating the drill string from a surface location and/or by a drilling motor (also referred to as the "mud motor") in the BHA to disintegrate the rock formation to drill the wellbore. The BHA includes devices and sensors for providing information about a variety of parameters relating to downhole operations, including tool face control of the BHA. A large number of wellbores are contoured and may include one or more vertical sections, straight inclined sections and curved sections (up or down). The weight-on-bit (WOB) applied on the drill bit while drilling a curved section (up or down) is often increased and the drill bit rotation speed (RPM) decreased as compared to the WOB and RPM used while drilling a vertical or straight inclined section. Control of the tool face is an important parameter for drilling smooth curved sections. A relatively aggressive drill bit (high cutter depth of cut) is generally desirable for drilling vertical or straight sections while a relatively less aggressive drill bit (low cutter depth of cut) is often desirable for drilling curved sections. The drill bits, however, are typically designed with cutters having the same depth of cut, i.e., a constant aggressiveness.

Therefore, it is desirable to provide a drill bit that will exhibit less aggressiveness during drilling of a curved section of a wellbore and more aggressiveness during drilling of a straight section of the wellbore.

SUMMARY

In one aspect, a drill bit is disclosed that may include at least one blade profile having at least one adjustable cutter on a cone section of the blade profile that retracts when an applied load on the drill bit exceeds a selected threshold.

In another aspect, a method of making a drill bit is provided which, in one embodiment, may include: forming at least one blade profile having a cone section; placing at least one adjustable cutter on the cone section, wherein the adjustable cutter is capable of retracting when an applied weight on the drill bit exceeds a threshold.

Examples of certain features of a drill bit and methods of making and using the same are summarized rather broadly in order that the detailed description thereof that follows may be better understood. There are, of course, additional features of the apparatus and methods disclosed hereinafter that will form the subject of the claims appended hereto.

BRIEF DESCRIPTION OF THE DRAWINGS

The disclosure herein is best understood with reference to the accompanying drawings, in which like numerals have generally been assigned to like elements and in which.

DETAILED DESCRIPTION OF THE EMBODIMENTS

Figure 1:
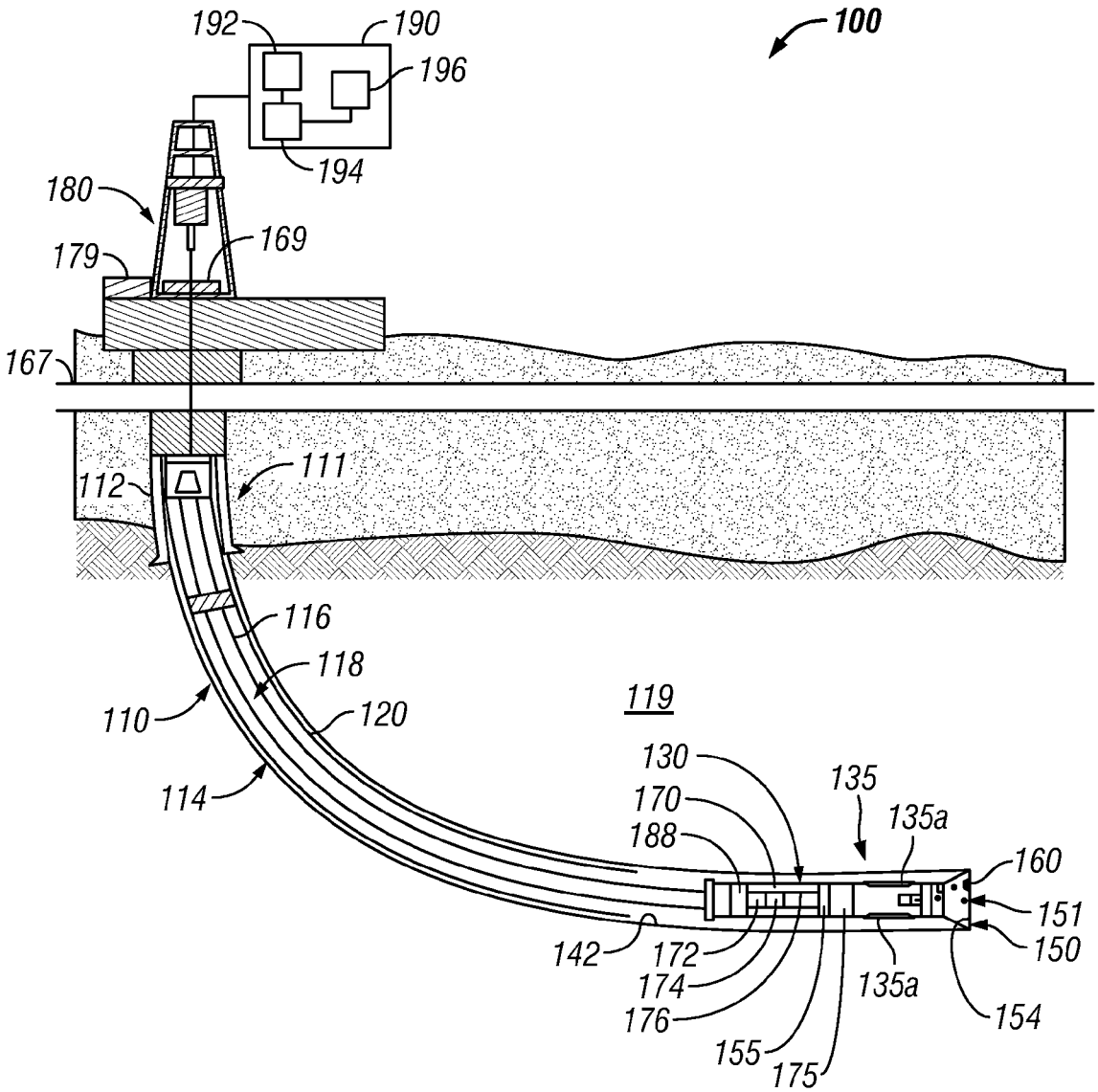
FIG. 1 is a schematic diagram of a an exemplary drilling system that includes a drill string that has a drill bit at an end of the drill string, made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be a coiled-tubing or made by joining drill pipe sections. A drill bit 150 is shown attached to the bottom end of the BHA 130 for disintegrating the rock formation 119 to drill the wellbore 110 of a selected diameter.

A drill string 118 is shown conveyed into the wellbore 110 from a rig 180 at the surface 167. The exemplary rig 180 shown is a land rig for ease of explanation. The apparatus and methods disclosed herein may also be utilized with an offshore rig. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. In one configuration, the BHA 130 may include a steering unit 135 configured to steer the drill bit 150 and the BHA 130 along a selected direction. In one aspect, the steering unit 130 may include a number of force application members 135*a* which extends from a retracted position to apply force on the wellbore inside. The force application members may be individually controlled to apply different forces so as to steer the drill bit to drill a curved wellbore section. Typically, vertical sections are drilled without activating the force application members 135*a*. Curved sections are drilled by causing the force application members 135*a* to apply different forces on the wellbore wall. The steering unit 135 may be used when the drill string comprises a drilling tubular (rotary drilling system) or coiled-tubing. Any other suitable directional drilling or steerable unit may be used for the purpose of this disclosure. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling a drilling fluid (or mud) 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 may include at least one blade profile 160 containing adjustable cutters on a cone section thereof made according to an embodiment described in more detail in reference to FIGS. 2A-4B. The BHA 130 may include one or more downhole sensors (collectively designated by numeral 175) for providing measurement relating to one or more downhole parameters. The sensors 175 may include, but not be limited to, sensors generally known as the measurement-while-drilling (MWD) sensors or the logging-while-drilling (LWD) sensors, and sensors that provide information relating to the behavior of the drill bit 150 and BHA 130, such as drill bit rotation (revolutions per minute or "RPM"), tool face, pressure, vibration, whirl, bending, stick-slip, vibration, and oscillation. The BHA 130 may further include a control unit (or controller) 170 configured to control the operation of the BHA 130, for at least partially processing data received from the sensors 175, and for bi-directional communication with a surface controller 190 via a two-way telemetry unit 188.

Figure 2A:
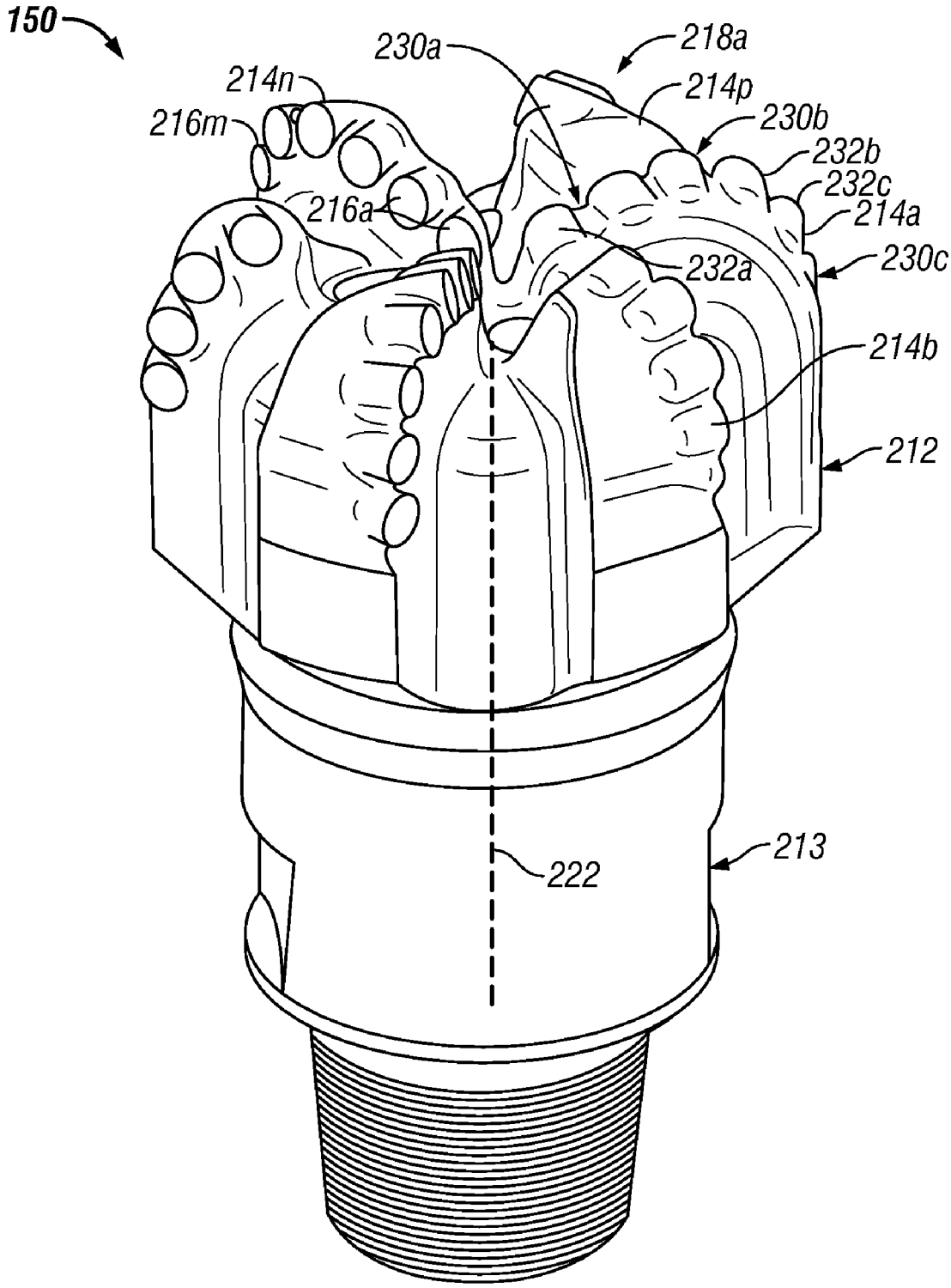
FIG. 2A is an isometric view of an exemplary drill bit showing placement of one or more adjustable cutters along a cone section of a blade profile, according to one embodiment of the disclosure.

FIG. 2A shows an isometric view of the drill bit 150 made according to one embodiment of the disclosure. The drill bit 150 shown is a polycrystalline diamond compact (PDC) bit that includes a cutting section 212 that contains cutting elements and shank 213 that connects to the BHA 130 about a center line 222. Cutting section 212 is shown to include a number of blade profiles 214*a*, 214*b*, 214*c* . . . 214*p* (also referred to as the "profiles"). Each blade profile is shown to include a cone section (such as section 230*a*), a nose section (such as section 230*b*) and a shoulder section (such as section 230*c*). Each such section further contains one or more cutters. For example, the cone section 230*a* is shown to include cutters 232*a*, nose section 230*b* is shown to contain cutters 232*b* and shoulder section 230*c* is shown to contain cutters 232*c*. Each blade profile terminates proximate to a drill bit center 215. The center 215 faces (or is in front of) the bottom of the wellbore 110 ahead of the drill bit 150 during drilling of the wellbore. A side portion of the drill bit 150 is substantially parallel to the longitudinal axis 222 of the drill bit 150. Each cutter has a cutting surface or cutting element, such as cutting element 216*a*' for cutter 216*a*, that engages the rock formation when the drill bit 150 is rotated during drilling of the wellbore. Each cutter 216*a*-216*m* has a back rake angle and a side rake angle that in combination define the depth of cut of the cutter into the rock formation and its aggressiveness. Each cutter also has a maximum depth of cut into the formation. The cutters on each cone section may be adjustable cutters as described in more detail in reference to FIGS. 3A-4B.

Figure 2B:
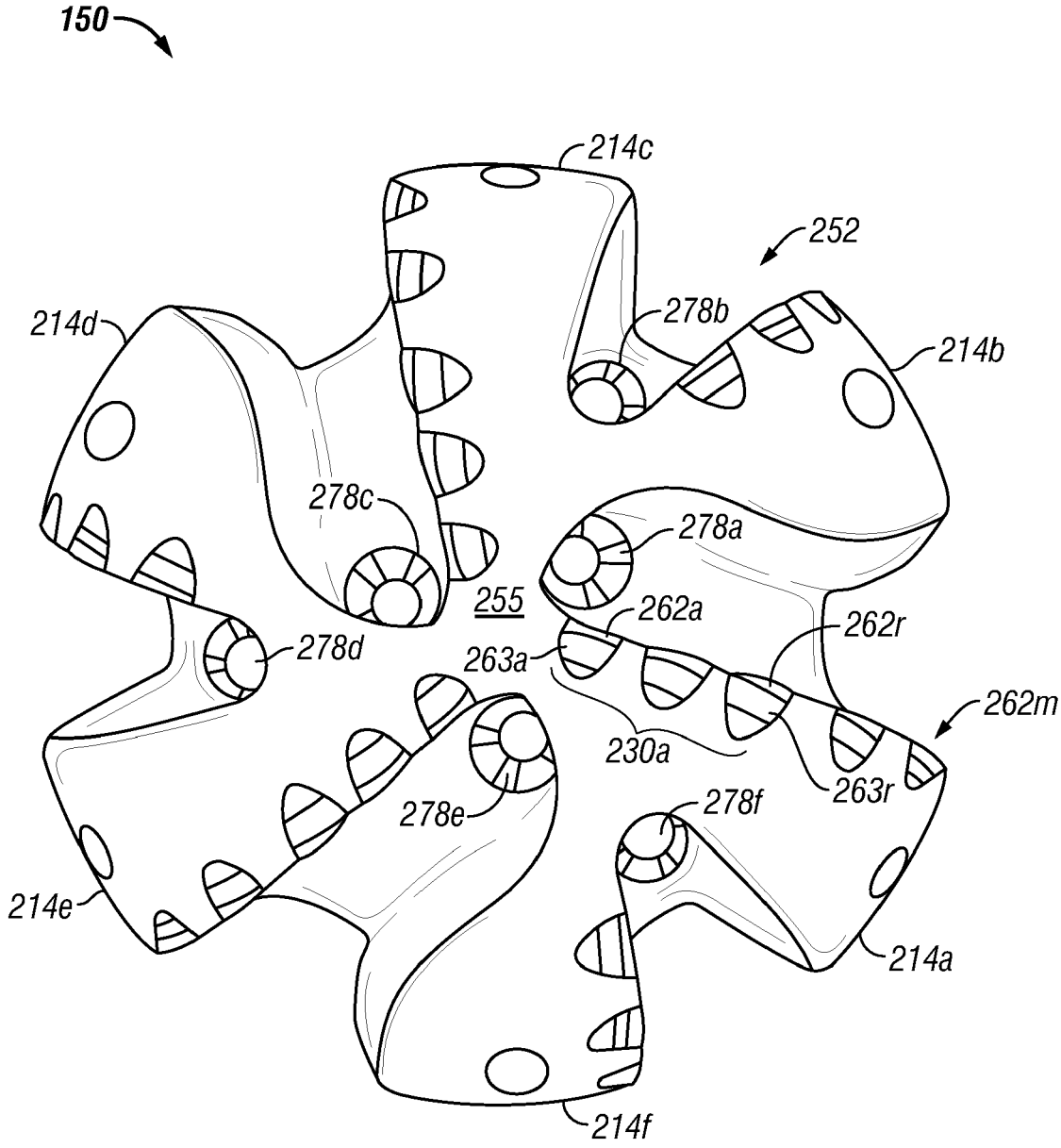
FIG. 2B shows an isometric view of the bottom of the drill bit shown in FIG. 2A with adjustable cutters on a cone section of the drill bit.

FIG. 2B shows an isometric view of a face section 250 of the exemplary PDC drill bit 150. The drill bit 150 is shown to include six blade profiles 214*a*-214*f*, each blade profile including a plurality of cutters, such as, for example, cutters 216*a*-216*m* positioned on blade profile 214*a*. Alternate blade profiles 214*a*, 2140*c* and 214*e* are shown converging toward the center 215 of the drill bit 150 while the remaining blade profiles 214*b*, 214*d* and 214*f* are shown terminating respectively at the sides of blade profiles 214*c*, 214*e* and 224*a*. Fluid channels 278*a*-278*f* discharge the drilling fluid 179 (FIG. 1) to the drill bit bottom. Each cone section includes one or more adjustable cutters. For example, cone section 230*a* of the blade profile 214*a* is shown to contain adjustable cutters 262*a*-262*r*, made according to one embodiment of the disclosure.

Figure 3A:
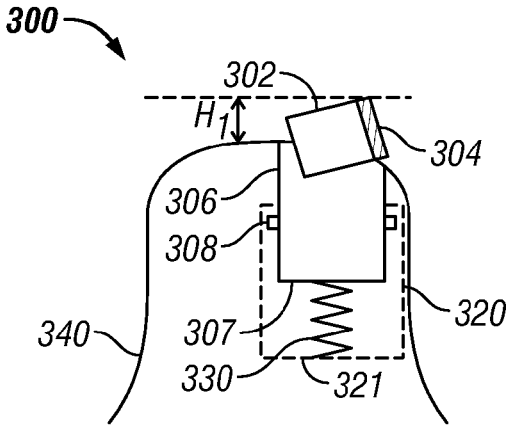
FIG. 3A shows a schematic drawing of an adjustable cutter assembly made according to one embodiment of the disclosure when the cutter is in a fully extended position.
Figure 3B:
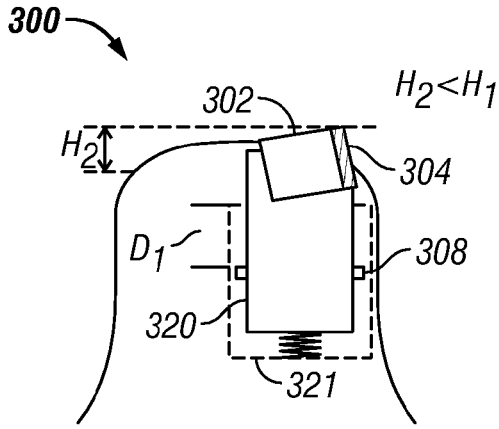
FIG. 3B is a schematic drawing showing the adjustable cutter of FIG. 3A in a retracted position when the applied load on the drill bit exceeds a threshold.

FIG. 3A shows an adjustable cutter 300, according to one embodiment of the disclosure. The cutter 300 includes a cutting element 302 having a cutting face 304. The cutting element 302 is coupled to a movable member 306 placed in a cutter pocket or cavity 320 in the blade profile 340 associated with the cutter 300. The movable member 306 may include retention members or mechanical stops 308 that retain the movable member or body 306 in the cavity 320. In one aspect, a compressible device 330, (such as a mechanical spring) having a stiffness or spring constant K may be placed between a bottom end 307 of the movable member 306 and bottom 321 of the cavity 320. In such a configuration, when a load applied on the cutting element 302 exceeds a threshold (based on the stiffness constant K), the movable member 306 pushes the compressible device 330, causing the movable member 330 to move into the cavity 320. FIG. 3A shows the cutting element 302 in its fully extended position, having a depth of cut $H_1$. FIG. 3B shows the movable member or body 306 moved a distance "D1" into the cavity 320. The cutting element 302 in such a retracted position is shown to have the cutting depth of $H_2$. The cutting depth $H_2$ being less than the cutting depth $H_1$. In one aspect, the spring constant K may be selected or preset for a selected threshold such that when the weight on the cutting element 302 is at or above the threshold, the movable member 306 will move into the cavity 320. The spring constant K may be set corresponding to a desired weight-on-bit.

Figure 4A:
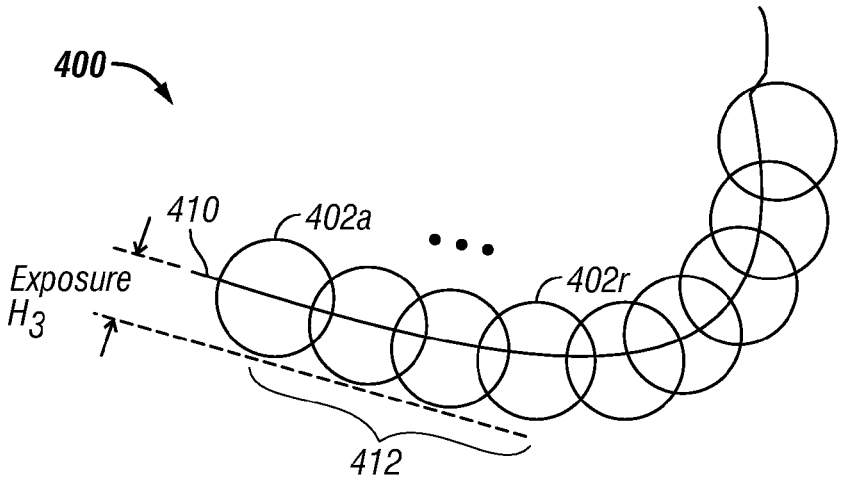
FIG. 4A is a schematic side view of a cutter profile showing fully extended adjustable cutters on a cone section of a drill bit.
Figure 4B:
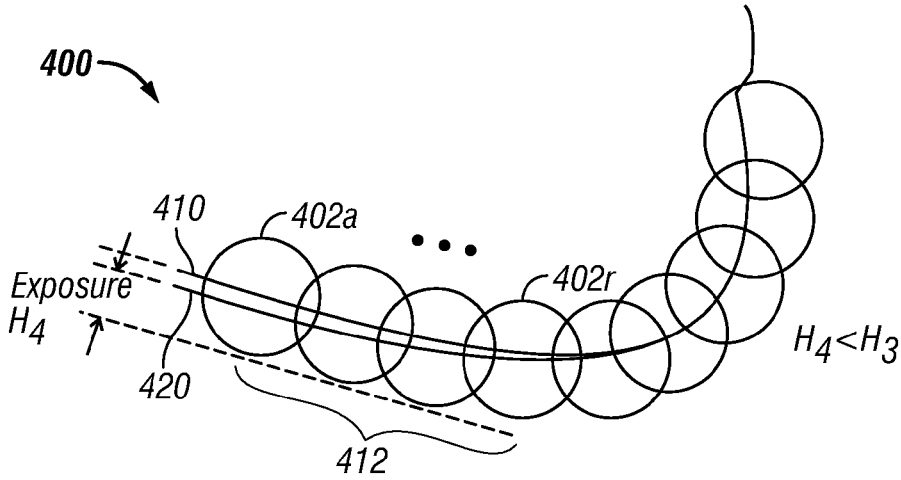
FIG. 4B is a schematic side view of the cutter profile shown in FIG. 4A showing the adjustable cutters in their respective retracted positions.

FIG. 4A is a schematic diagram of an exemplary cutter profile 400 having adjustable cutters 402*a*-402*r* on its cone section 412. FIG.4A shows the cutters 402*a*-402*r* in their fully extended or exposed positions having a cutting depth $H_3$. The cutters 402*a*-402*r* are most aggressive when they are in their fully extended positions relative to the blade profile 410, as shown in FIG. 4A. FIG. 4B shows a cutter profile wherein the cutters 402*a*-402*r* on the cone section 412 are at a reduced exposure relative to the blade profile 420 with a cutting depth $H_4$. The cutters 402*a*-402*r* are least aggressive when they are fully retracted. The drill bit according to one embodiment may be designed to exhibit a full depth of cut (i.e. most aggressive) and a least depth of cut (i.e., least aggressive). In one aspect, the spring constant K of the adjustable cutters 402*a*-402*r* may be chosen based on a selected threshold, such as a value of the WOB. During drilling, when the WOB is at or above the selected threshold, the adjustable cutters will retract to a retracted position, such as shown in FIG. 4B, with the depth of cut $H_4$ being less than the depth of cut H3. The retraction may depend upon the WOB. In one aspect, the spring constant K for all the adjustable cutters 402*a*-402*r* may be the same. In another aspect, the spring constants may be different based on their respective locations on profile. In addition, one or more cutters on a nose and/or shoulder sections of the drill bit may be adjustable cutters.

As noted earlier, directional drilling of a wellbore may include drilling vertical sections, straight sections and curved sections (sliding or building angle). In the case of directional drilling, two modes of operation are typical: slide mode (also known in the art as the "orientation mode" or "steer mode") and rotate mode (also referred to in the art as the "hold mode" or "drop mode."). Typically, in the slide mode, increased WOB and lower bit RPM are employed to build the desired wellbore trajectory angle and to maintain the desired tool face. As noted earlier, maintaining the desired tool face is an important parameter for drilling a smooth curved section. This also assists in attaining high rate of penetration and reduced torsional vibrations. In the rotate mode, reduced WOB and higher RPM are typically employed to achieve higher ROP. In the rotate mode, tool face control is not a very important parameter. In the drill bit described herein, certain cutters extend or retract relative to a blade profile surface (i.e., move up or down) depending upon the amount of WOB used and the spring constant of the compressible member. Assuming, for example, a particular spring is rated for a specific WOB (say 15 thousand pounds) and the WOB actually used in the rotate mode is 12 thousand pounds. In this circumstance, the spring will not compress during the rotate mode and the adjustable cutters will remain aggressive (higher depth of cut). Assuming that in the slide mode the WOB is above 12 thousand pounds (say between 20-30 thousand pounds), then the spring will compress a certain amount, based on the spring tension. As the spring compresses, the cutter's exposure will be reduced, thereby allowing a portion of the bit profile (matrix) to come in contact with the formation. This allows for improved tool face control, reduced torque and reduced vibrational oscillations. The reduced cutter exposure essentially brings the rock closer to the drill bit. Thus, the drill bits described herein operate in an aggressive manner in a rotate mode and in a less aggressive manner in a slide mode.

Thus, the disclosure in one aspect provides a drill bit that may include at least one blade profile having a cone section and at least one adjustable cutter on the cone section that retracts when an applied load on the drill bit is at or above a selected threshold. In one aspect, the at least one adjustable cutter may include a movable cutting element that retracts from an extended position when the load on the drill bit is at or above the selected threshold. The adjustable cutter, in another aspect, may further include a compressible member that compresses when the load on the drill bit is at or above the threshold. The compressible member may be placed in a cutter pocket or cavity into which the cutting element retracts.

In another aspect, the drill bit may include a plurality of blade profiles. Each such blade profile may include a plurality of adjustable cutters on a cone section of each such blade profile. Each such cutter may include a cutting element configured to retract when an applied load on the drill bit is at or above a threshold value. A compressible element between each cutting element and a cutter pocket or cavity bottom defines motion of the cutting element when the load on the drill bit is at or above the threshold.

In another aspect, the disclosure provides a method of making a drill bit that may include: forming at least one blade profile having a cone section; providing a cutting element having a cutting surface; placing the cutting element in a cavity on the cone section; placing a compressible element in the cavity which compressible member compresses when a load on the cutting element reaches or exceeds a selected threshold, causing the cutting element to retract from an extended position. The cutting element may include a body which moves in the cavity. A retention member associated with the cutting element may be formed to retain the cutting element body in the cavity. The cutting element may be formed as an assembly that may be placed in and retrieved from an associated pocket in the blade profile.

in another aspect, a method of drilling a wellbore is provided, which in one embodiment may include: conveying a drilling assembly having a drill bit at an end thereof into the wellbore, the drill bit including cutters that are configured to move from an extended position to a retracted position based on an applied weight-on-bit, and wherein the drill bit is less aggressive when the cutters are in the retracted position compared to when the cutters are in the extended position; drilling a first section of the wellbore with the cutters in the extended position; increasing the weight-on bit to cause the cutters to retract; and drilling a second section of the wellbore with cutters in the retracted position. The first section of the wellbore may be a straight section and the second section a curved section. In one aspect, the wellbore may be drilled by using a bottomhole assembly having the drill bit at a bottom end thereof and a steerable unit configured to guide the drill bit along a desired direction. In one aspect, the steerable unit may include a plurality of force application members configured to apply force on an inside wall of the wellbore to steer the drill bit along the selected direction.

The foregoing disclosure is directed to certain specific embodiments of a drill bit, a system for drilling a wellbore utilizing the drill bit and methods of making such a drill bit for ease of explanation. Various changes and modifications to such embodiments, however, will be apparent to those skilled in the art. All such changes and modifications are to be considered a part of this disclosure and being within the scope of the appended claims.

The invention claimed is:

1. A drill bit, comprising:

at least one blade profile having a cone section; and at least one cutter on the cone section that retracts from an extended position to a retracted position when a load applied on the drill bit is at or above a threshold, wherein a depth of cut for the drill bit is greater in the extended position than it is in the retracted position.

2. The drill bit of claim 1, wherein the at least one cutter comprises a cutting element configured to move within a cutter cavity.

3. The drill bit of claim 2, wherein the at least one cutter further comprises a compressible member in the cutter cavity that compresses when the load on the drill bit is at or above the threshold.

4. The drill bit of claim 3, wherein the compressible member is a spring having a spring constant K.

5. The drill bit of claim 4, wherein the at least one cutter further comprises a retaining member configured to retain a portion of the cutting element in the cutter cavity.

6. The drill bit of claim 1, wherein the at least one cutter comprises a plurality of cutters on the cone section, each such cutter comprising a cutting element placed in a cavity having a compressible member therein that enables the cutting element to retract into the cavity when the load on the drill bit is at or above the threshold.

7. The drill bit of claim 1 wherein the at least one blade profile further comprises a nose section and a shoulder section and retractable cutter on at least one of the nose section and the shoulder section.

8. An apparatus for use in a wellbore, comprising:

a drill bit; and a drilling motor configured to rotate the drill bit, and wherein the drill bit comprises:

at least one blade profile having a cone section and at least one cutter on the cone section that retracts when an applied load on the drill bit is at or above a selected threshold so as to decrease aggressiveness of the drill bit from a selected value during drilling of a selected section of the wellbore, wherein a depth of cut for the drill bit is greater in an extended position than it is in a retracted position.

9. The apparatus of claim 8, wherein the at least one cutter comprises a movable cutting element that retracts from an extended position when the load on the drill bit is at or above the selected threshold.

10. The apparatus of claim 8, wherein the at least one cutter comprises a compressible member that compresses when the load on the drill bit is at or above the threshold.

11. The apparatus of claim 9, wherein the compressible member is placed in a cavity in which the cutting element retracts.

12. The apparatus of claim 8, wherein the at least one cutter comprises a plurality of cutters on the cone section, each such cutter comprising a cutting element placed in a cavity comprising a spring therein that enables the cutting element to retract into the cavity when the load on the drill bit is at or above the threshold.

13. The apparatus of claim 8, wherein the drill bit is attached to a bottom hole assembly that includes a rotary drilling system for drilling.

14. A method of making a drill bit, comprising:

forming at least one blade section having a cone section;

providing a cutting element having a cutting surface;

placing the cutting element in a cavity on the cone section; and placing a compressible element, having a selected stiffness constant, in the cavity that compresses when a load on the cutting element reaches or exceeds a selected threshold, causing the cutting element to retract from an extended position to a retracted position, wherein a depth of cut for the drill bit is greater in the extended position than it is in the retracted position.

15. The method of claim 14, wherein forming the cutting element comprises forming a cutting element on a cutter body, which cutter body is configured to move into the cavity.

16. The method of claim 14 further comprising providing a retention member that causes the cutter body to remain in the cavity.

17. A method of drilling a wellbore, comprising:

conveying a drilling assembly, having a drill bit at an end thereof, into the wellbore, the drill bit including cutters that are configured to move from an extended position to a retracted position based on an applied weight-on-bit, and wherein the drill bit is less aggressive when the cutters are in the retracted position compared to when the cutters are in the extended position;

drilling a first section of the wellbore with the cutters in the extended position;

increasing the weight-on bit to cause the cutters to retract; and drilling a second section of the wellbore with cutters in the retracted position, wherein a depth of cut for the drill bit is greater in the extended position than it is in the retracted position.

18. The method of claim 17, wherein the first section of the wellbore is a straight section and the second section is a curved section.

19. The method of claim 18 further comprising using a bottomhole assembly having the drill bit at a bottom end thereof and a steerable unit configured to guide the drill bit along a selected direction.

20. The method of claim 19, wherein the streerable unit comprises a plurality of force application members configured to apply force on an inside wall of the wellbore to steer the drill bit in the selected direction.

* * * * *